US007340907B2

(12) United States Patent
Vogh, III

(10) Patent No.: US 7,340,907 B2
(45) Date of Patent: Mar. 11, 2008

(54) ANTI-CONDENSATION CONTROL SYSTEM

(75) Inventor: Richard P. Vogh, III, Marietta, GA (US)

(73) Assignee: Computer Process Controls, Inc., Kennesaw, GA (US)

( * ) Notice: Subject to any disclaimer, the term of this patent is extended or adjusted under 35 U.S.C. 154(b) by 171 days.

(21) Appl. No.: 11/124,909

(22) Filed: May 9, 2005

(65) Prior Publication Data

US 2005/0268627 A1 Dec. 8, 2005

Related U.S. Application Data

(60) Provisional application No. 60/569,581, filed on May 10, 2004.

(51) Int. Cl.

| | |
|---|---|
| ***F25D 23/12*** | (2006.01) |
| ***F25D 21/00*** | (2006.01) |
| ***B01F 3/02*** | (2006.01) |
| ***G05D 21/00*** | (2006.01) |

(52) U.S. Cl. ..... 62/150; 236/44 R; 236/44 A; 165/222; 165/223

(58) Field of Classification Search ..... 62/150, 62/93, 80, 140, 156, 265; 236/44 R, 44 A; 165/222, 223, 230

See application file for complete search history.

(56) References Cited

U.S. PATENT DOCUMENTS

| | | | |
|---|---|---|---|
| 1,553,039 | A | 9/1925 | Gray |
| 1,757,718 | A | 5/1930 | Kauffmann |
| 2,443,342 | A | 6/1948 | Colvin |
| 2,460,469 | A | 2/1949 | Rifkin et al. |
| 2,492,970 | A | 1/1950 | Curry |
| 2,494,480 | A | 1/1950 | MacMaster |
| 2,504,520 | A | 4/1950 | Greiling |
| 2,542,136 | A | 2/1951 | Hanson et al. |
| 2,647,374 | A | 8/1953 | Stoner |
| 2,657,546 | A | 11/1953 | Smith |
| 2,672,735 | A | 3/1954 | Fusselman |
| 2,687,621 | A | 8/1954 | Fitzgerald |

(Continued)

FOREIGN PATENT DOCUMENTS

| | | |
|---|---|---|
| DE | 42 22 544 A1 | 1/1994 |

(Continued)

OTHER PUBLICATIONS

Pulse Modulating Anti-Sweat Control Operation and Installation Manual, Computer Process Controls, Inc.,Jan. 16, 1995; 14 pages.

*Primary Examiner*—Chen Wen Jiang
(74) *Attorney, Agent, or Firm*—Harness, Dickey & Pierce, PLC

(57) ABSTRACT

An anti-condensation control apparatus for a refrigeration device generally includes a sensor module and a control module. The control module receives an input from the sensor module and compares the input to a set point. The control module generates an output indicative of a difference between the input and the set point and updates the output based on the input from the sensor module. A heater modulator controls a heater based on the output from the control module to maintain a temperature of the outer surface of a refrigerated device such that relative humidity adjacent the sensor module is substantially between 90-95 percent relative humidity, or slightly above dew point.

24 Claims, 6 Drawing Sheets

U.S. PATENT DOCUMENTS 2,696,087 A 12/1954 Luecke
2,706,387 A 4/1955 Swanson
2,731,804 A 1/1956 Grubbs, Sr.
2,858,408 A 10/1958 Barroero
2,953,908 A 9/1960 Petrone et al.
2,960,844 A 11/1960 Quick
3,025,681 A 3/1962 Booth
3,038,319 A 6/1962 Kesling
3,145,305 A 8/1964 Levy
3,174,297 A 3/1965 Kuhn et al.
3,263,063 A 7/1966 Marriott et al.
3,379,859 A 4/1968 Marriott
3,414,713 A 12/1968 Reifeiss et al.
3,415,308 A 12/1968 Levy
3,443,395 A 5/1969 Schweiger
3,462,966 A 8/1969 Reid et al.
3,475,594 A 10/1969 Aisanich
3,499,245 A 3/1970 Winsler et al.
3,527,289 A 9/1970 Foessl
3,612,821 A 10/1971 Stromquist
3,724,129 A 4/1973 Stromquist
3,790,745 A 2/1974 Levin
3,859,502 A 1/1975 Heaney
3,911,245 A 10/1975 O'Shaughnessy
3,922,874 A 12/1975 Canter
3,939,666 A 2/1976 Bashark
3,968,342 A 7/1976 Inaba
4,035,608 A 7/1977 Stromquist et al.
4,052,691 A 10/1977 Nagano et al.
4,112,703 A 9/1978 Kountz
4,127,765 A 11/1978 Heaney
4,142,092 A 2/1979 Abrams
4,145,893 A 3/1979 Vogel
4,192,149 A 3/1980 Webb
4,193,111 A 3/1980 Wester
4,248,015 A 2/1981 Stromquist et al.
4,260,876 A 4/1981 Hochheiser
4,261,179 A 4/1981 Dageford
4,306,140 A 12/1981 Stromquist
4,341,089 A 7/1982 Ibrahim et al.
4,357,524 A 11/1982 Apfelbeck et al.
4,373,350 A 2/1983 Noland
4,548,049 A 10/1985 Rajgopal
4,586,122 A 4/1986 Self
4,626,697 A 12/1986 Nelson
4,663,941 A 5/1987 Janke
4,691,486 A 9/1987 Niekrasz et al.
4,716,486 A 12/1987 Sobiepanek et al.
4,831,493 A * 5/1989 Wilson et al. ..... 361/286
4,843,831 A 7/1989 Yamada
4,843,833 A 7/1989 Polkinghorne
4,845,329 A 7/1989 Vaz et al.
4,862,701 A 9/1989 Small et al.
4,896,589 A 1/1990 Takahashi
4,911,357 A 3/1990 Kitamura
4,950,869 A 8/1990 Mueller
4,951,473 A 8/1990 Levine et al.
4,967,568 A 11/1990 Harnden, Jr. et al.
4,975,592 A 12/1990 Hahn et al.
4,982,318 A 1/1991 Maeba et al.
4,990,057 A 2/1991 Rollins
4,993,233 A 2/1991 Borton et al.
5,008,829 A 4/1991 Cox et al.
5,095,710 A 3/1992 Black et al.
5,103,649 A 4/1992 Kieffer
5,161,383 A 11/1992 Hanson et al.
5,173,586 A * 12/1992 Gold ..... 219/203
5,189,350 A 2/1993 Mallett
5,189,888 A 3/1993 Anderson et al.
5,203,175 A 4/1993 Farrey et al.
5,212,954 A 5/1993 Black et al.
5,220,478 A 6/1993 Innes et al.
5,231,844 A 8/1993 Park
5,237,830 A 8/1993 Grant
5,307,256 A 4/1994 Silverstein
5,329,781 A 7/1994 Farrey et al.
5,341,284 A 8/1994 Huang
5,402,059 A 3/1995 Bittar
5,448,442 A 9/1995 Farag
5,449,885 A 9/1995 Vandecastele et al.
5,463,874 A 11/1995 Farr
5,479,785 A 1/1996 Novak
5,510,972 A 4/1996 Wong
5,606,232 A 2/1997 Harlan et al.
5,621,631 A 4/1997 Vinciarelli et al.
5,624,591 A 4/1997 Di Trapani
5,646,514 A 7/1997 Tsunetsugu
5,778,689 A 7/1998 Beatenbough
5,784,232 A 7/1998 Farr
5,899,078 A 5/1999 Mager
6,014,325 A 1/2000 Pecore
6,144,017 A 11/2000 Millett et al.
6,220,039 B1 4/2001 Kensok et al.
6,220,042 B1 4/2001 Robillard et al.
6,226,995 B1 5/2001 Kalempa et al.
6,301,913 B1 10/2001 Schulak et al.
6,324,853 B1 12/2001 Kelly et al.
6,406,266 B1 6/2002 Hugenroth et al.
6,437,957 B1 8/2002 Karuppana et al.
6,466,424 B1 10/2002 Larranaga et al.
6,467,282 B1 10/2002 French et al.
6,470,696 B1 10/2002 Palfy et al.
6,580,590 B2 6/2003 Holmquist et al.
6,668,917 B1 * 12/2003 Zeng ..... 165/202
6,760,207 B2 7/2004 Wyatt et al.
6,801,031 B1 10/2004 Stephen
2001/0002540 A1 6/2001 Okubo
2004/0040321 A1 * 3/2004 Lo Presti et al. ..... 62/156
2004/0083748 A1 5/2004 Homan et al.
2004/0195343 A1 10/2004 Schmitt et al.

FOREIGN PATENT DOCUMENTS

EP 0 154 119 A1 9/1985
EP 0 494 785 A1 7/1992
GB 1 239 223 7/1971
JP 02120156 A * 5/1990

* cited by examiner

ANTI-CONDENSATION CONTROL SYSTEM

CROSS-REFERENCE TO RELATED APPLICATIONS

This application claims the benefit of U.S. Provisional Application No. 60/569,581, filed on May 10, 2004. The disclosure of the above application is incorporated herein by reference.

FIELD

A system and method for preventing condensation and, more particularly, a system and method for operating anti-condensation heaters.

BACKGROUND

Refrigerated spaces such as refrigerated display cases, walk-in refrigerators, and walk-in freezers commonly include heaters to prevent condensation from forming on certain areas of the device from water vapor present as humidity in the surrounding air. For example, walk-in refrigerators and freezers typically employ a heater to prevent condensation from forming on air vents, personnel doors, drain lines, and observation windows. Similarly, refrigerated display cases such as coffin cases, island cases, and tub cases typically employ a heater to prevent condensation from forming on and around an opening and/or door of the display case.

For example, glass-door refrigerated display cases are frequently used in supermarkets and convenience stores and often include heaters in the glass doors and the door frames to prevent condensation on the glass from humid air. The glass doors and frames are typically heated to a temperature above the dew-point temperature of the air in the room in which the display cases are located to prevent condensation.

Prior art control systems apply heat to the glass doors in proportion to a measured dew point in an open-loop system. Manual intervention, in the form of manually adjusting the control scheme, is required to achieve condensation-free doors. The adjustment process is prone to human error, typically resulting in setting the heat too high and losing some of the promised energy savings. Also, such adjustments usually are made at a particular operating condition, and may not work correctly year round where climate changes are more drastic, as dew point and conditions change with the season. Further, the adjustment process is time consuming and does not result in a known door temperature.

One method of controlling the amount of heat applied to the display case doors includes applying full power (i.e., line voltage, typically) to the door heaters. The applied heat prevents condensation but wastes energy as more heat is applied than is necessary. The excess energy consumed by the door heaters directly increases the cost of operating the refrigeration system. Such costs are further increased as excess energy in the form of heat is dissipated into the refrigerated space and must be removed by the refrigeration system.

Other control systems modulate the heat applied to the display case doors and, as a result, reduce door heat energy and related costs. Such systems generally control the applied proportion of maximum heat, which is proportional to the square of line voltage to adjust the heat applied to the doors. While such systems adequately reduce the amount of heat applied to the doors, such systems suffer from the disadvantage of being susceptible to variations in line voltage and are therefore not precise.

For example, as illustrated in FIG. 1, a prior art proportional controller has one or more adjustments to allow a user to adjust a door heater between a minimum and a maximum in response to variation of dew point of the room air (i.e., more heat for higher dew point). Some systems permit limiting the upper and lower limits of the heat modulation to values other than zero and one hundred percent, e.g., limiting the heat to a twenty percent minimum and a ninety percent maximum. Others have a simple rotary dial that adjusts a gain or an offset. Still others define limits as endpoints of a line, as illustrated in FIG. 2, which shows control over a 3-segment line. Segment 1, which is at a low dew point, shows modulation held at twenty percent of full heat. In segment 2, modulation varies with dew points between 25 and fifty degrees F. dew point. In segment 3, modulation is ninety percent, of full heat, for high dew points.

SUMMARY

An anti-condensation control apparatus for a refrigeration device generally includes a sensor module and a control module. The control module receives an input from the sensor module and compares the input to a set point. In addition, the control module generates an output indicative of a difference between the input and the set point and continuously updates the output based on the input from the sensor module. A heater modulator controls a heater based on the output from the control module to maintain a temperature such that air adjacent the sensor module is substantially between 90-95 percent relative humidity.

Alternatively, an anti-condensation control apparatus for a refrigeration device may include two sensors and a control module. One sensor detects the dew point of room air. The other of the two sensors detects at least one of the door temperature and door frame temperature. The control module operates a heater modulator, which may be an integral part of the control module, to maintain the temperature sensor at a temperature slightly above the dew point of the room air. Maintaining the temperature sensor at a temperature slightly above the dew point of room air allows the control module to maintain a surface to which the sensor is mounted to be maintained at a similar temperature and, thus, prevents condensation forming thereon.

Further areas of applicability of the present teachings will become apparent from the detailed description provided hereinafter. It should be understood that the detailed description and specific examples are intended for purposes of illustration only and are not intended to limit the scope of the teachings.

BRIEF DESCRIPTION OF THE DRAWINGS

The present teachings will become more fully understood from the detailed description and the accompanying drawings, wherein.

DETAILED DESCRIPTION

The following description is merely exemplary in nature and is in no way intended to limit the teachings, its application, or uses.

The control system and method achieves a temperature slightly higher than the dew point of humid air adjacent a control surface of a component of a refrigeration device to prevent condensation from forming on the control surface. For example, the control system maintains air adjacent a door of a refrigerated display case, or an observation window of a walk-in refrigerator or freezer, slightly above the dew point of humid air adjacent the door or observation window to maintain the respective component free from condensation. Thus, the relative humidity of the humid air adjacent the component—the air which has been cooled to component temperature—is high, but less than one hundred percent. Because humid air has a dew point, or temperature at which relative humidity is one hundred percent, cooling the humid air to a temperature below the dew point causes water vapor to condense.

If the temperature of the component (i.e., glass door or observation window) is below the dew point of the humid air in the room where the component is located, the cool air of the room will cool the humid air at the component below the dew point, which will cause moisture to condense thereon. But, if the temperature of the component is slightly above the dew point of room air, the humid air touching the component will be cooled, but not to the point of causing condensation.

The system and method according to the present teachings may be used in a variety of refrigeration and freezer applications such as, but not limited to, display cases, walk-in refrigerators, and walk-in freezers, to control the temperature of any control surface. For example, walk-in refrigerators and freezers could employ the present system to prevent condensation from forming on air vents, personnel doors, drain lines, walls, and observation windows. Similarly, refrigerated display cases such as coffin cases, island cases, and tub cases could employ the present system to prevent condensation from forming on any wall or surface surrounding an opening and/or door of the display case. While the present system is applicable to each of the aforementioned refrigeration and freezer applications, the present system will be described in association with a refrigerated display case having a glass door.

To achieve the system and method according to the present teachings, a relative humidity sensor 10 may be mounted on a control surface, such as a door 12 or other structure of a refrigerator/refrigerated case 14, such that the sensor itself, and the air it monitors, are cooled to a control surface temperature. The sensor 10 may be mounted to any portion of the door 12 or structure of the refrigerator/refrigerated case 14 so long as the structure to which the sensor 10 is mounted is indicative of the temperature of the control surface.

Figure 4:
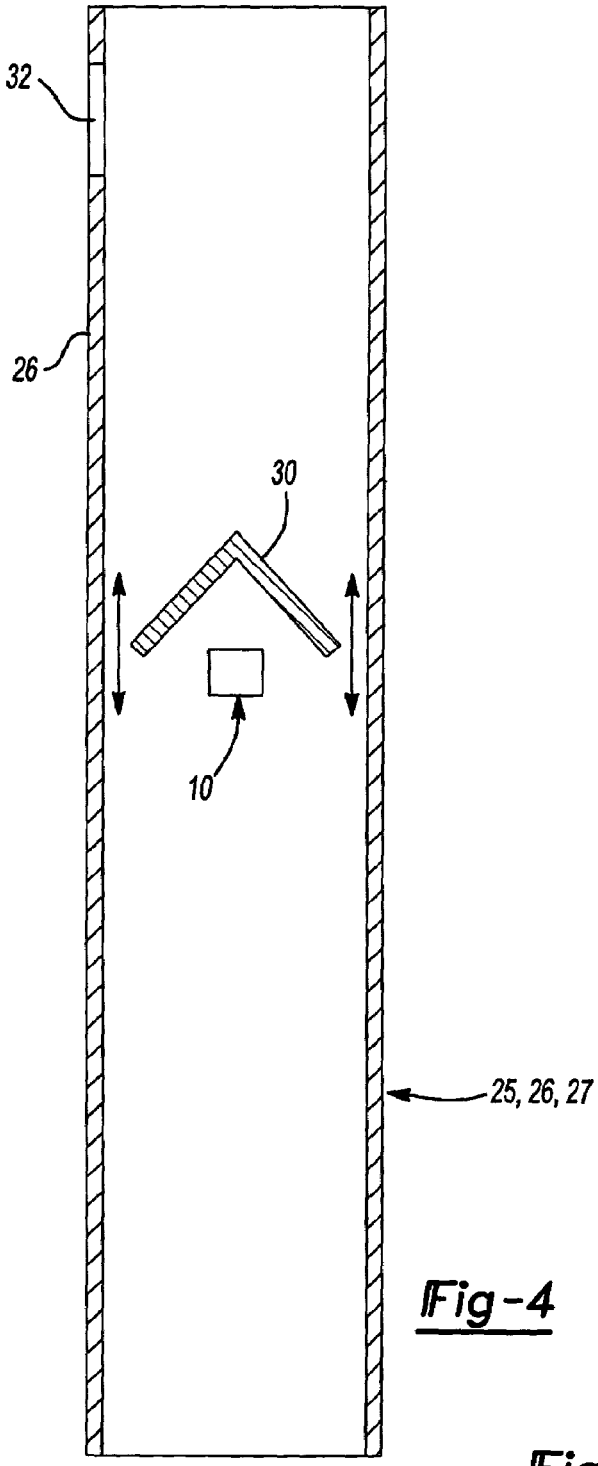
FIG. 4 is a cross-sectional view of a relative humidity sensor incorporating a drip-shielding baffle and disposed within a door casing or door frame.
Figure 5:
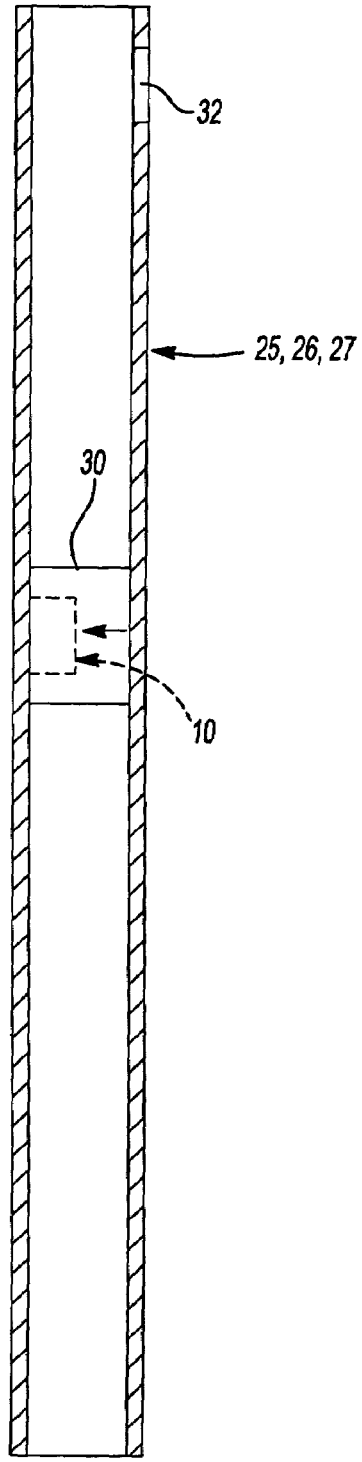
FIG. 5 is a cross-sectional view of a relative humidity sensor showing the drip-shielding baffle of FIG. 4 from another direction.

For example, if a glass pane of the door 12 is deemed the control surface (i.e., the portion of the door 12 to maintain free from condensation), the sensor 10 may be mounted directly to the glass pane or, alternatively, to support structure either on the door 12, such as a door casing 25 generally surrounding the glass pane, or to surrounding support structure, such as a door frame 26 that operably supports the door 12. The door casing 25 and door frame 26 are schematically represented in FIGS. 4 and 5. The sensor 10 may be mounted either on the glass pane, door casing 25, or door frame 26 or within the glass pane, door casing 25, or door frame 26, provided that the respective structure is generally at the same temperature as the control surface. By mounting the sensor 10 in close proximity to the control surface, the sensor 10 is able to accurately measure the relative humidity of air adjacent the control surface.

Mounting the RH sensor 10 within the door casing 25 or door frame 26 protects the sensor 10 from dust, moisture, or other liquids. For example, the sensor 10 and appropriate drip protection or baffles 30, may be arranged on a small plate, which is mounted in a hole cut into the door casing 25 or door frame 26. The casing 25 or frame 26 may be further modified to include air vents 32, such as screens, louvers or small holes, generally above and below the sensor location. By locating the sensor 10 approximately in the middle portion of a vertical portion of the door casing 25 or door frame 26, adequate air flow over the sensor 10 may provide a reliable relative humidity measurement. Such arrangements are shown in FIGS. 4 and 5.

The RH sensor 10 may be arranged in a thin vertical tube 27 (represented schematically in FIGS. 4 and 5) having baffles 30 near the sensor 10 to prevent moisture or dust from falling on the sensor 10, and to prevent water or other cleaning solutions from dripping onto the sensor 10. The vertical tube 27 may be thermally in contact with the door 12, so that the tube 27 is at approximately the same temperature as the door 12. The tube 27 may permit air flow vertically, so that air passes by the relative humidity sensor 10 located inside the tube 27. The tube 27 should be long enough to cool air passing therethrough to door temperature, or close to door temperature, before passing over the sensor 10. Furthermore, the tube 27 should have a path long enough for cooling air both above and below the sensor 10 so that the air is cooled before reaching the sensor 10, regardless of the direction of air flow (i.e., due to air currents in the room can cause flow in either direction).

While the RH sensor 10 may be mounted within a door casing 25, door frame 26, and/or tube 27 including air inlets and outlets 32 at the top and bottom thereof to accommodate air flow, air inlets 32 may also, or alternatively be, located on the front or the sides of the respective assembly (i.e., casing 25, frame 26, or tube 27), which lessens the opportunity for water to drip into the assembly or dust to collect on the assembly. Such an arrangement may be useful where the RH sensor 10 is not mounted inside the door frame 26 (e.g., when mounted on an external surface of the door frame 26). Possible arrangements are shown in FIGS. 6, 7, and 8.

Figure 6:
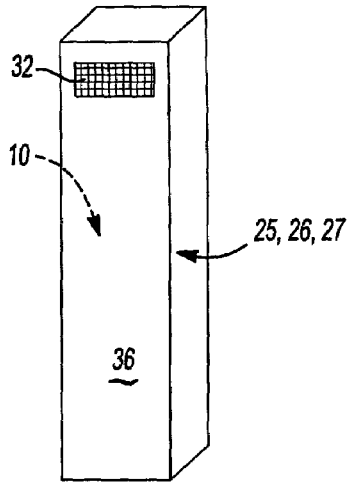
FIG. 6 is a perspective view of an air flow path of a relative humidity sensor incorporating a housing having an open bottom portion and an air passage formed in a side wall.
Figure 7:
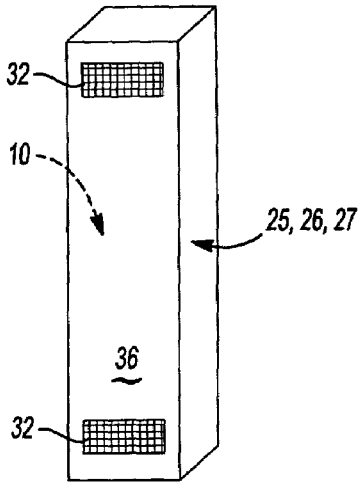
FIG. 7 is a perspective view of a relative humidity sensor in accordance with the principles of the present teachings incorporating a housing having a pair of air passages formed in a side wall.
Figure 8:
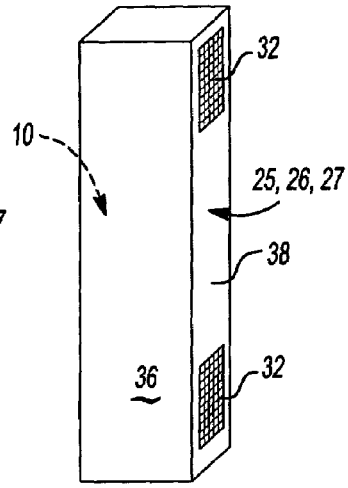
FIG. 8 is a perspective view of a relative humidity sensor in accordance with the principles of the present teachings incorporating a housing having a pair of air passages formed in another side wall.

FIGS. 6 and 7 illustrate air entry and exit holes 32 on a front surface 36 of the door casing 25, door frame 26, and tube 27 with the arrangement of FIG. 7 having an open bottom for air flow. FIG. 8 illustrates air entry and exit holes 23 on sides 38 of the door casing 25, door frame 26, and tube 27. Note, however, that the air entry and exit holes may be on both sides or, if mounted on the door frame 26, preferably on the side toward the door glass only. The RH sensor 10 may be made as thin as practical, measuring from front to back, to sense air as close to the door surface as possible, and thus nearly at door temperature. Furthermore, casing 25, frame 26 and tube 27 may be open or closed at both ends to tailor the flow of air therein. Such arrangements may be particularly appropriate for RH sensors 10 not mounted inside a door frame 26.

While the RH sensor 10 is described as being associated with a door of a refrigerator/refrigerated case, it should be understood that the sensor 10 may alternatively be used with an open refrigerator/refrigerated case or a walk-in refrigerator/freezer. In such applications, the sensor 10 can be mounted on any surface to be controlled (i.e., for which prevention of condensation is desired), such as walls, windows, doors, housing rails, or other support structure.

Figure 1:
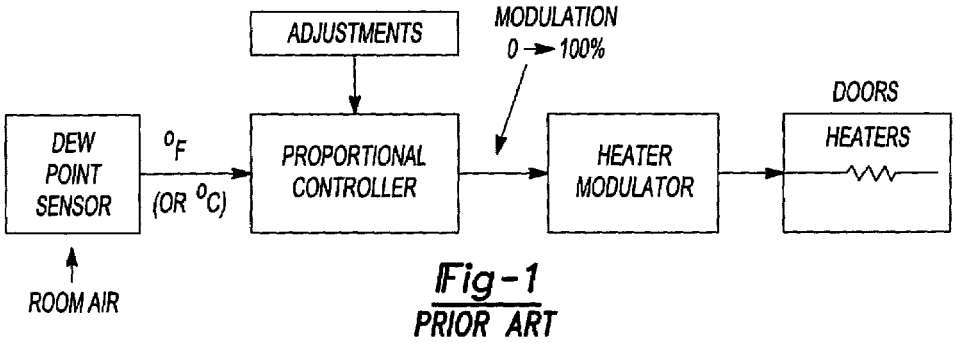
Fig-1 PRIOR ART
FIG. 1 is a schematic representation of a prior art proportional controller.
Figure 2:
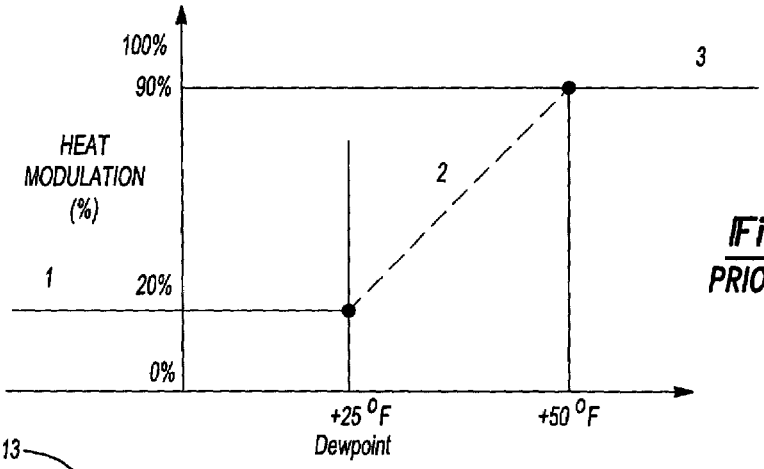
Fig-2 PRIOR ART
FIG. 2 is a graph showing percentage heat modulation versus temperature for a prior art door heater control system.
Figure 3:
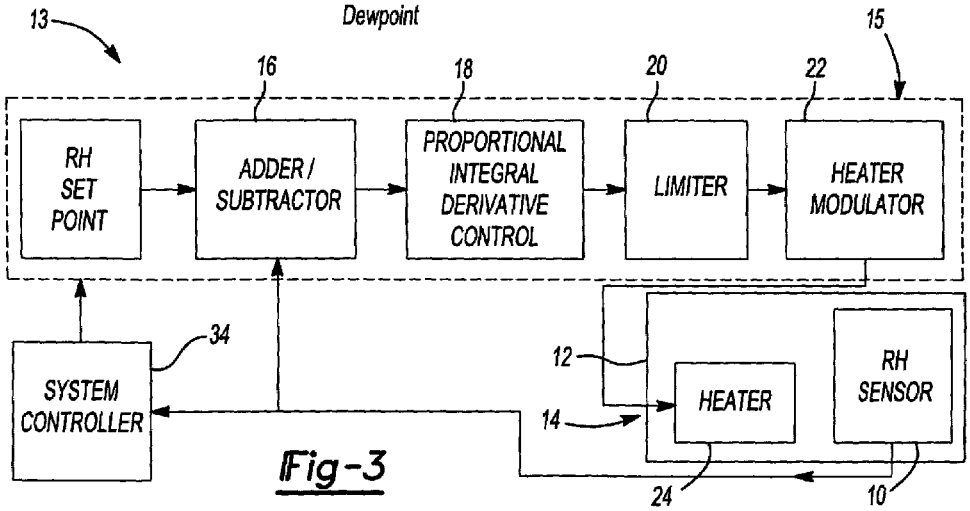
FIG. 3 is a schematic representation of an anti-condensation control scheme in accordance with the present teachings.

An anti-condensation control system 13 employing a heater controller 15 having an adder-subtractor 16, a proportional integral controller (PID) 18, a limiter 20, and a heater modulator 22 is illustrated in FIG. 3. The RH sensor 10 provides an input to the adder-subtractor 16, which also receives a RH set point as an input. The set point may be provided at ninety percent, and the adder-subtractor 16 determines an error, which is input to the PID controller 18 to determine an output between zero and one hundred percent. The output may be applied to the limiter 20 having a percent minimum and percent maximum output to be applied to the heater modulator 22, which controls a door heater 24 as the RH sensor 10 at the door 12 continues to supply an input to the adder-subtractor 16 for comparison to the set point. Thus, the anti-condensation control system 13 provides closed-loop control. While a PID controller is disclosed, other control logic, such as, but not limited to, fuzzy logic, may also be used with the control system 13, and should be considered within the scope of the present teachings.

The control system 13 according to the present teachings may have a set point at a relatively high RH value, such as ninety or 95 percent. The RH set point may be adjusted for lack of accuracy in the RH sensor 10 or to account for temperature variations at different areas of the door 12. For example, if parts of the door 12 are cooler than the air flowing over the RH sensor 10, a lower RH set point (RHSP) may be appropriate, such as lowering the RHSP to eighty percent. Lowering the RHSP ensures that the entire door 12 remains free from condensation by applying additional heat to cooler areas of the door 12.

The set point may never have to be adjusted, particularly if there is a control system for each door 12. In such systems, it is not necessary to provide accessibility to the system to make adjustments to the set point as user intervention is not required to properly adjust the control system 13. This feature, in system design, may result in considerable cost savings.

Figure 9:
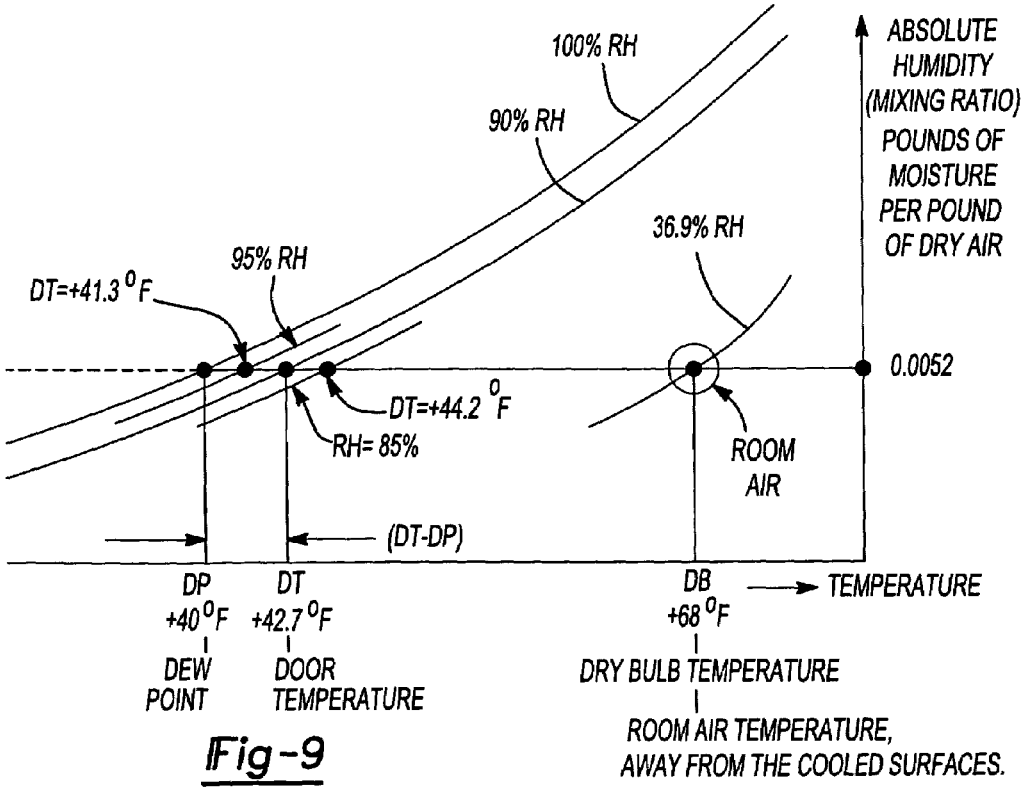
FIG. 9 is a psychrometric chart for use with the anti-condensation control scheme of FIG. 3.

With reference to FIG. 9, operation of the control system 13 can be illustrated by plotting an example on a psychrometric chart. The system control goal is to maintain relative humidity at the RH sensor 10 at ninety percent relative humidity, i.e., RHSP equaling approximately ninety percent. In a room having a dry bulb temperature of +68 degrees F. and relative humidity of 36.9 percent (away from the refrigerated surfaces), the dew point is +40 degrees F., which is determined by extending a line horizontally from the air condition to a point on the one hundred percent RH curve in FIG. 9. The control point is where that same horizontal line intersects ninety percent RH, and the heater modulator 22 will apply just enough heat to bring the door temperature to +42.7 degrees F., which is slightly above the dew point. Further, if the RH sensor 10 indicates 95 percent relative humidity, the controller 15 would apply more heat as the door temperature is +41.3 degrees F. If the RH sensor 10 indicates 85 percent relative humidity, the controller 15 would reduce the heat being applied, as the door temperature is +44.2 degrees F. Thus, the controller 15 will adjust the heat applied until the RH sensor 10 achieves ninety percent relative humidity.

Figure 10:
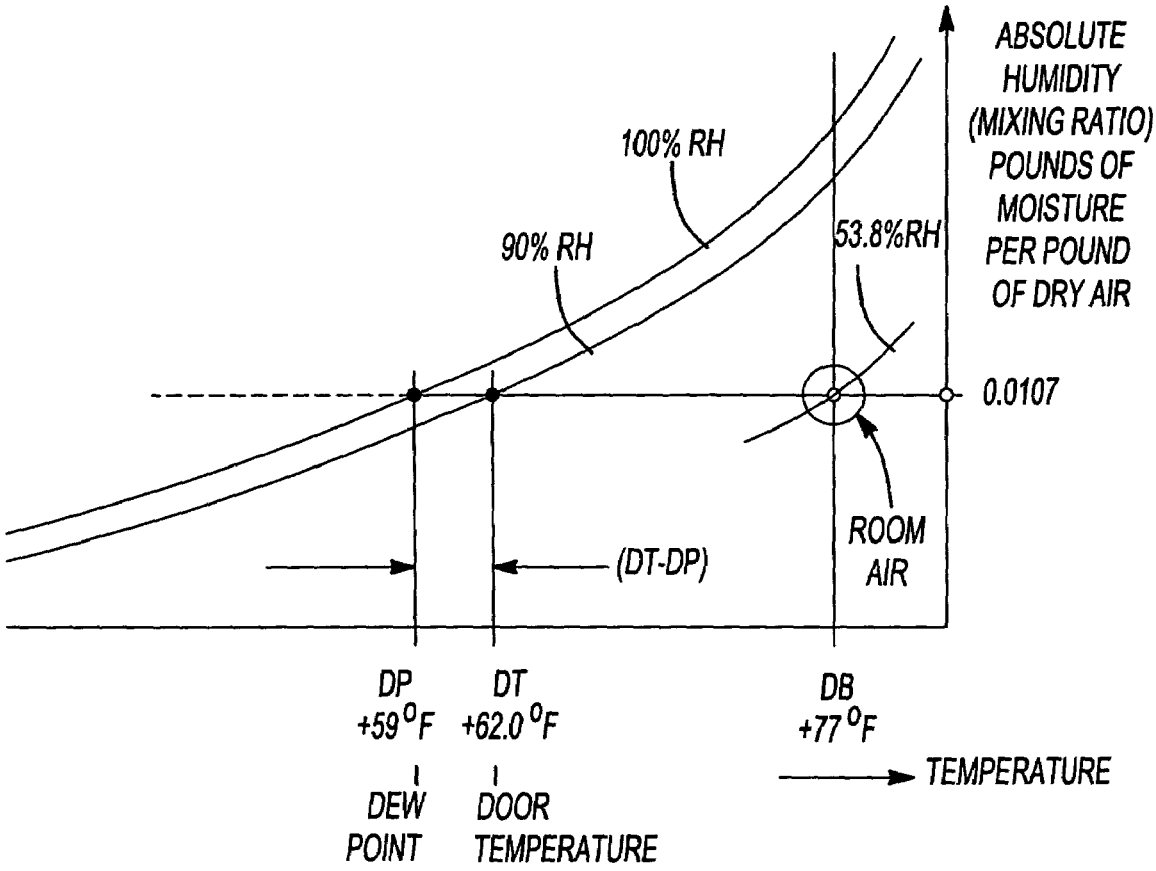
FIG. 10 is another psychrometric chart for use with the anti-condensation control scheme of FIG. 3, wherein water vapor is at twice the amount as the psychrometric chart of FIG. 9.

Another psychrometric chart is illustrated in FIG. 10, where water vapor (i.e., airborne moisture, humidity) is present at approximately twice the amount as in the example of FIG. 9, which is noted on the vertical axis of the psychrometric chart of FIG. 10. Where FIG. 9 included 0.0052 pounds of moisture per pound of dry air, FIG. 7 illustrates 0.0107 pounds of moisture per pound of dry air. While in FIG. 9, DT minus DP equals 2.7 degrees F., the differential in FIG. 10 is 3.0 degrees F. In both situations, however, controlling the heat to maintain the RH sensor 10 at ninety percent relative humidity causes the door temperature to be about 3 degrees F. above the dew point. This approximate differential of door temperature over dew point is true over a wide variation of airborne moisture or humidity.

A separate control system 13 may be applied to each door 12 of a refrigerated display case such that one controller 15 may be used to control heaters 24 for a plurality of doors 12. For example, the RH sensor 10 may be located in the side of one door 12 that is closest to another door 12 sought to be controlled, (i.e., adjacent doors 12) to control both doors 12. The heaters 24 of both doors 12 may be connected in parallel and be driven by the same controller 15. For three adjacent doors 12, the RH sensor 10 may be mounted in the middle door 12. The heaters 24 of all three doors 12 may be connected in parallel and be driven by one controller 15. The system and method may include three different heater outputs, all modulated in the same way, but each output powered by a different phase of three-phase power.

In a system incorporating multiple doors 12, each anti-condensation system 13 may be monitored and tracked separately to diagnose faults associated with each door 12 and/or system 13. In this manner, each system 13 may be in communication with a main controller 34 that tracks system performance and updates the RH set point, when necessary. The refrigeration controller 34 is preferably an Einstein of E2 Area Controller offered by CPC, Inc. of Atlanta, Ga., or any other type of programmable controller that may be programmed.

Another apparatus and method for preventing condensation includes controlling component temperature in relation to a measured dew point in order to minimize heater energy use. A closed-loop control system 40 according to the present teachings efficiently prevents condensation and lowers energy use, while providing automated adjustment of the system 40. Like control system 13, control system 40 may be used in a variety of refrigeration and freezer application such as, but not limited to, display cases, walk-in refrigerators, and walk-in freezers. For example, the control system 40 may be employed in walk-in refrigerators and freezers to prevent condensation from forming on air vents, personnel doors, drain lines, and observation windows. Similarly, refrigerated display cases such as coffin cases, island cases, and tub cases could employ the control system 40 to prevent condensation from forming on and around an opening and/or door of the display case. While the control system 40 is applicable to each of the aforementioned refrigeration and freezer applications, the control system 40 will be referred to hereinafter and in the drawings as associated with a refrigerated display case having a glass door.

Figure 11:
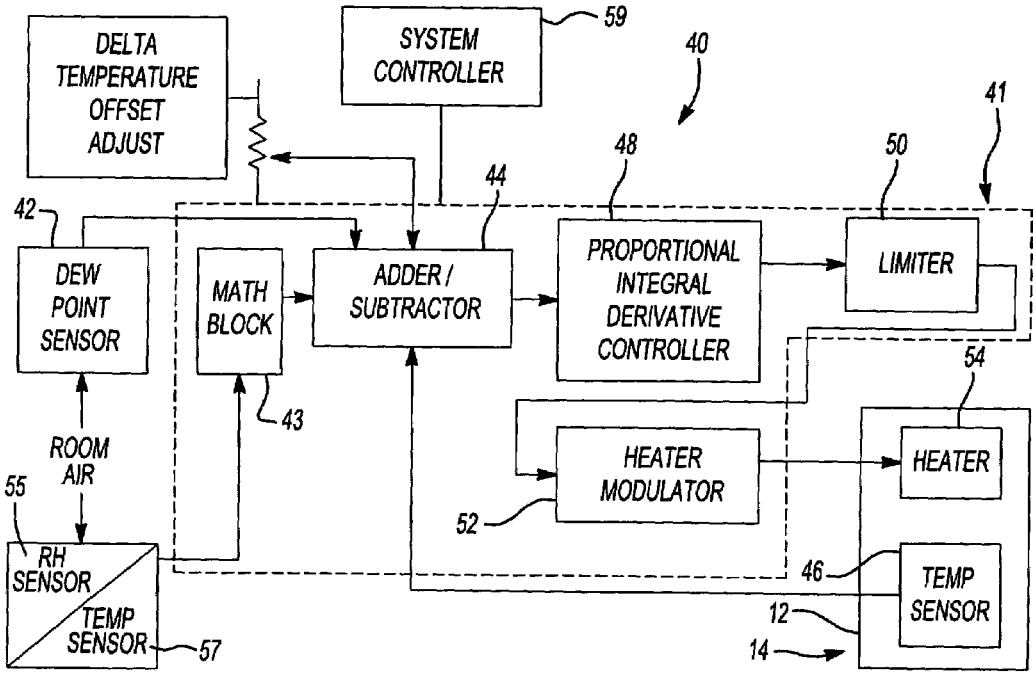
FIG. 11 is a schematic representation of another anti-condensation control system in accordance with the principles of the present teachings.

As shown in FIG. 11, the apparatus and method includes measuring and controlling door temperature to a temperature equal to dew-point temperature of the room air, plus a delta temperature offset. Thus, the door temperature is held at slightly above dew-point temperature, which is an optimum door temperature for preventing condensation with minimum heat applied to the doors 12.

With reference to FIG. 11, the anti-condensation control system 40 is shown including a dew-point sensor 42 and a heater controller 41 having a math block 43, an adder-subtractor 44, a proportional integral controller (PID) 48, a limiter 50, and a heater modulator 52. The dew-point sensor 42 provides a temperature measurement to the adder/subtractor 44, which also receives a delta temperature offset for adjusting the measurement received by the dew-point sensor 42. Further, the adder/subtractor 44 receives a temperature measurement from a temperature sensor 46 located on the door 12 of the refrigerated display case and determines an error value between the dew-point sensor input plus the delta temperature offset, and the temperature measurement received from the temperature sensor 46. This error value is applied to the proportional integral derivative (PID) controller 48, which outputs a percentage to the limiter 50, which limits the output percentage to a predetermined percentage minimum and/or percentage maximum. The limiter 50 outputs an adjusted demand signal to the heater modulator 52, which then applies heat to the doors 12 via heater 54 in accordance with the required demand. While a PID controller is disclosed, other control logic, such as, but not limited to, fuzzy logic, may also be used with the control system 40, and should be considered within the scope of the present teachings.

In addition to the foregoing, the control system 40 may include a relative humidity sensor 55 and a temperature sensor 57 in place of the dew-point sensor 42, and a math block 43 in the heater controller 41. The relative humidity sensor 55 detects door temperature relative humidity and supplies an input indicative thereof to the math block 43 while the temperature sensor 57 measures ambient temperature and provides an input indicative thereof to the math block 43. The math block 43 computes the dew point based on the inputs from the relative humidity sensor 55 and temperature sensor 57. Therefore, the control system 40 could employ a stand-alone dew-point sensor 42 or could use a math block 43 in conjunction with a relative humidity sensor 55 and a temperature sensor 57 to compute the dew point. In either event, the dew point is fed to the adder-subtractor 44 for processing, as previously discussed.

In a system incorporating multiple doors 12, the performance of each anti-condensation system 40 may be separately monitored and tracked to diagnose faults associated with each door 12 and/or system 40. In this manner, each system 40 may be in communication with a system controller 59 that tracks system performance and updates system parameters, when necessary.

Figure 12:
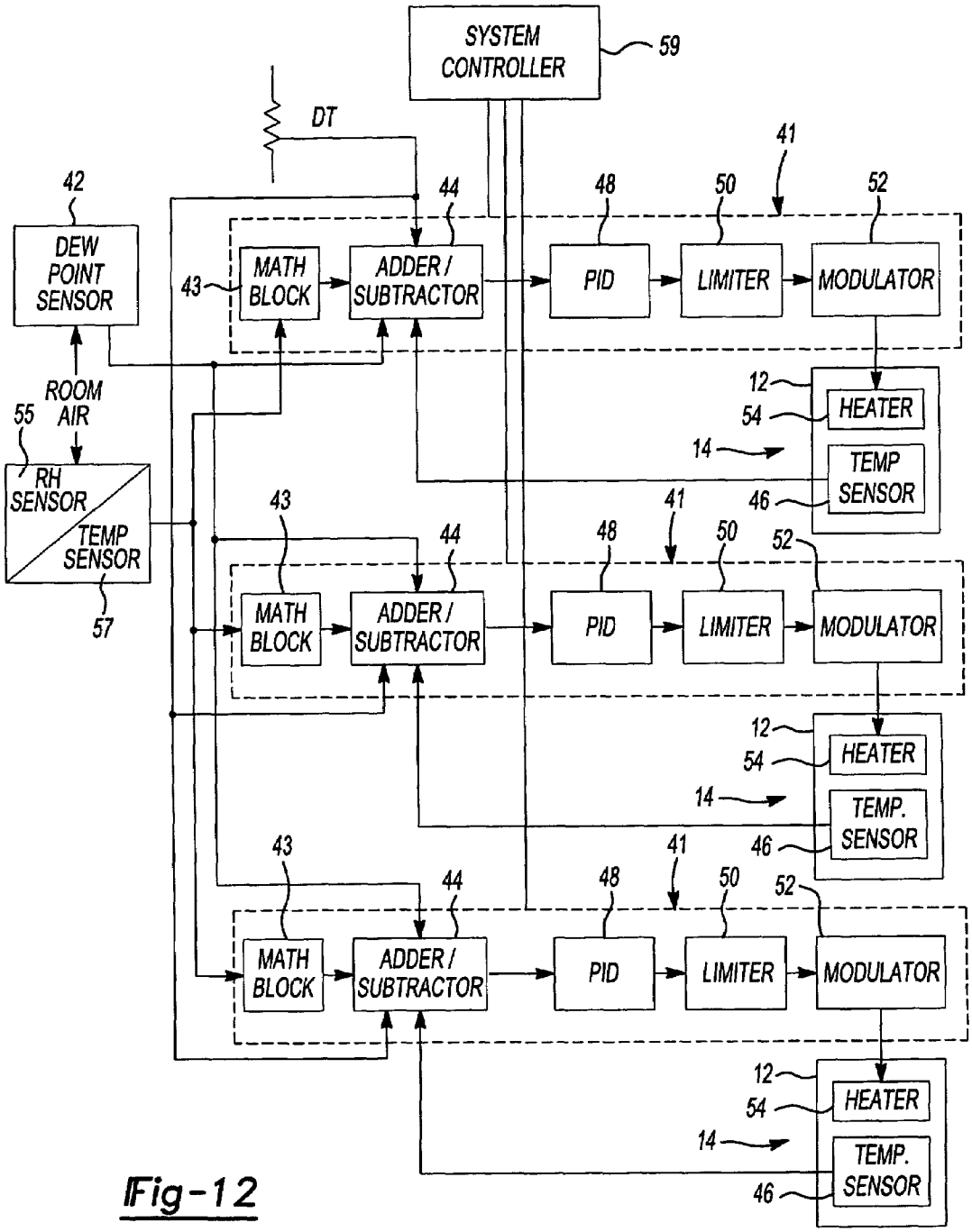
FIG. 12 is a schematic representation of the control system of FIG. 11 applied to a plurality of doors.

In FIG. 12, a dew-point sensor 42 for the room provides an input for temperature control of multiple doors 12, which collectively are subject to a single delta temperature offset. Doors with different heat loads, such as when one is open, are all precisely controlled to a temperature just above the dew point. It should be understood that the arrangement shown in FIG. 12 may alternatively include a relative humidity sensor 55 and a temperature sensor 57 (with math blocks 43 in the heater controllers 41) in place of the dew-point sensor 42.

The system and method may also include a temperature sensor 46 on one door 12, but the system and method controls heaters 54 in all similar doors 12, for example, a group of doors 12 for a single refrigerated display case or a circuit, based on a single door temperature sensor measurement. While this arrangement provides lower installation cost by eliminating multiple door temperature sensors 46, it may require a higher delta temperature offset to ensure that other door temperatures remain above the dew point for dependable prevention of condensation on all the doors 12. Accordingly, the energy cost savings may be less than an arrangement where each door 12 includes its own door temperature sensor 46.

A similar arrangement would include a door temperature sensor 46 for each door 12, but the door temperatures being averaged before being input to the PID controller 48. A similar variation would include a door temperature sensor 46 for each door 12, but apply the minimum door temperature to the PID controller 48. For this arrangement, each door 12 would remain above the dew-point temperature, but may not result in the maximum energy savings because some door temperatures may be relatively high compared to the dew-point temperature.

As described above for the RH sensors 10, the door temperature sensors 46 can be arranged on the glass, on the frame 26, in the frame 26, or any of the variations discussed above, as well as any reasonable alternatives.

The description is merely exemplary in nature and, thus, variations are intended to be within the scope of the teachings and are not to be regarded as a departure from the spirit and scope of the teachings.

What is claimed is:

1. An anti-condensation control apparatus for a refrigeration device comprising:

a sensor module;

a control module receiving an input from said sensor module and operable to compare said input to a set point and generate an output indicative of a difference between said input and said set point, said control module continuously updating said output based on said input from said sensor module; and a heater modulator operable to control a heater based on said output to maintain air adjacent said sensor module to a temperature such that relative humidity at said sensor module is generally between 90-95 percent.

2. The apparatus of claim 1, wherein said control module uses closed-loop control to control said heater.

3. The apparatus of claim 1, wherein said sensor module includes a sensor mounted to a control surface selected from the group comprising: a glass pane, a casing, a frame, a rail, or a wall of the refrigeration device.

4. The apparatus of claim 3, wherein said sensor is fixedly attached to said control surface.

5. The apparatus of claim 3, wherein said control surface is disposed within said casing, frame, rail, or wall of the refrigeration device.

6. The apparatus of claim 5, wherein said casing, frame, rail, or wall includes an air passage to allow said adjacent air to interact with said sensor.

7. The apparatus of claim 5, wherein said sensor includes at least one sensor module baffle protecting said sensor from debris.

8. The apparatus of claim 1, wherein said sensor module is disposed within a tube fixedly attaching said sensor to the refrigeration device.

9. The apparatus of claim 8, wherein said tube is generally open at one end.

10. The apparatus of claim 8, wherein said tube includes a baffle protecting said sensor from debris.

11. The apparatus of claim 8, wherein said tube includes at least one air passage to allow said adjacent air to interact with said sensor.

12. The apparatus of claim 1, wherein said sensor module includes a relative humidity sensor.

13. The apparatus of claim 1, wherein said control module includes a controller and at least one of an adder-subtractor and a limiter.

14. The apparatus of claim 13, wherein said controller comprises a proportional integral derivative controller.

15. An anti-condensation control apparatus for a bank of refrigeration devices comprising:

a sensor module positioned on a control surface of at least one of the refrigeration devices;

a control module receiving an input from said sensor module and operable to compare said input to a set point and generate an output indicative of a difference between said input and said set point, said control module continuously updating said output based on said input from said sensor module; and a heater modulator operable to control a heater of each of the refrigeration devices based on said output to maintain a temperature of air adjacent a control surface of each of the refrigeration devices and the sensor module to a temperature such that relative humidity at the sensor module is generally between 90-95 percent.

16. The apparatus of claim 15, wherein said control module uses closed-loop control to control said heater.

17. The apparatus of claim 15, wherein said sensor module is mounted to said control surface and said control surface is selected from the group comprising: a glass pane, a casing, a frame, a rail, or a wall of the refrigeration device.

18. The apparatus of claim 15, wherein said sensor module includes a relative humidity sensor.

19. A method of controlling condensation on a refrigeration device, the method comprising;

sensing a condition of air adjacent a sensor associated with the refrigeration device;

comparing said input to a set point;

outputting an error based on said comparison;

processing said error to determine an output between zero and one hundred percent;

modifying said output between a percent minimum and percent maximum; and heating a surface of the refrigeration device adjacent said sensor to maintain a temperature of said surface such that the relative humidity at said sensor is approximately 90-95 percent.

20. The method of claim 19, wherein said sensing a condition of air includes sensing a relative humidity of said air adjacent said sensor.

21. The method of claim 20, further comprising sensing a temperature of said surface.

22. A method of controlling condensation on a refrigeration device, the method comprising:

sensing a condition of air adjacent a sensor associated with the refrigeration device;

comparing said input to a set point;

outputting an error based on said comparison;

processing said error to determine an output between zero and one hundred percent;

modifying said output between a percent minimum and percent maximum; and heating a surface of the refrigeration device to maintain a temperature of said air adjacent said sensor such that the relative humidity of said sensor is approximately 90-95 percent.

23. The method of claim 22, wherein said modifying includes use of closed-loop control.

24. The method of claim 22, wherein said sensing a condition of air includes sensing a dew point of said air adjacent said sensor.

* * * * *